US006848184B2

(12) United States Patent
Cheng

(10) Patent No.: US 6,848,184 B2
(45) Date of Patent: Feb. 1, 2005

(54) SINGLE BLADE FOLDABLE KNIFE

(75) Inventor: Yang-Fu Cheng, Taipei (TW)

(73) Assignee: Kantas Products Co., Ltd., Taipei (TW)

( * ) Notice: Subject to any disclaimer, the term of this patent is extended or adjusted under 35 U.S.C. 154(b) by 0 days.

(21) Appl. No.: 10/265,668

(22) Filed: Oct. 8, 2002

(65) Prior Publication Data

US 2004/0064953 A1 Apr. 8, 2004

(51) Int. Cl.[7] ..... B26B 1/04
(52) U.S. Cl. ..... 30/155; 30/161; D8/99
(58) Field of Search ..... 30/154, 155, 158, 30/159, 160, 161, 164; D8/99, 100

(56) References Cited

U.S. PATENT DOCUMENTS 2,098,678 A * 11/1937 Schrade ..... 30/159
4,426,779 A * 1/1984 Morgan ..... 30/158 X
5,495,674 A * 3/1996 Taylor, Jr. ..... 30/160
5,546,662 A * 8/1996 Seber et al. ..... 30/161
5,794,346 A * 8/1998 Seber et al. ..... 30/161
6,105,255 A * 8/2000 Cheng ..... 30/161
6,591,504 B2 * 7/2003 Onion ..... 30/160
6,684,510 B1 * 2/2004 Collins ..... 30/161
2002/0066187 A1 * 6/2002 Jennings ..... 30/161

* cited by examiner

*Primary Examiner*—Clark F. Dexter
(74) *Attorney, Agent, or Firm*—Bacon & Thomas PLLC

(57) ABSTRACT

A single blade foldable knife. The knife includes a planar-shaped handle section, a blade pivotably conjoined to an appropriate position at one extremity of the handle section, and a protective component disposed on the handle section at a position facing the tip of the blade cutting edge, such that when the blade is folded, the top of the blade cutting edge is nested in the protective component. In the stored position, the cutting edge totally incapable of external contact and, therefore, the protective component safeguards the user from injury due to touching the blade when the foldable knife is grasped, picked up, or carried, and prevents the scoring of other objects by the cutting edge, and protects the cutting edge from wear.

4 Claims, 2 Drawing Sheets

SINGLE BLADE FOLDABLE KNIFE

BACKGROUND OF THE INVENTION

1) Field of the Invention

The invention herein relates to a single blade foldable knife.

2) Description of the Prior Art

A conventional single blade foldable knife consists of a planar-shaped handle section, a blade pivotably conjoined to an appropriate position at one extremity of the handle section, a mildly contoured facet along the back of the blade as well as a cutting edge formed on its opposite surface, and a resilient member suitably situated on the said handle section, the resilient member providing for manual pressing by the user to fold the blade and, when the blade is unfolded, a section of the resilient member that is postured against the bottom portion of the blade to further lock the blade into position.

However, when the conventional single blade foldable knife is folded, the tip of the blade cutting edge is exposed such that if the foldable knife is incautiously grasped, picked up, or carried, the user is easily incised by the tip of the cutting edge and, furthermore, other objects stored with the foldable knife are scored by the cutting edge, while the cutting edge is worn down due to contact with other objects.

SUMMARY OF THE INVENTION

The objective of the invention herein is to provide a single blade foldable knife consisting of a planar-shaped handle section, a blade pivotably conjoined to an appropriate position at one extremity of the handle section, and a protective component disposed on the handle section at a position facing the tip of the blade cutting edge, such that when the blade is folded, the tip of the blade cutting edge is nested in the protective component, rendering the cutting edge totally incapable of external contact and, therefore, the protective component safeguards the user from injury due to touching the blade when the foldable knife is grasped, picked up, or carried, prevents the scoring of other objects by the cutting edge, and protects the cutting edge from wear due to other objects.

The above and other objects, features and advantages of the present invention will become apparent from the following detailed description taken with the accompanying drawings.

BRIEF DESCRIPTION OF THE DRAWINGS

FIG. 3 is an isometric drawing of another embodiment of the invention herein.

DETAILED DESCRIPTION OF THE INVENTION

Figure 1:
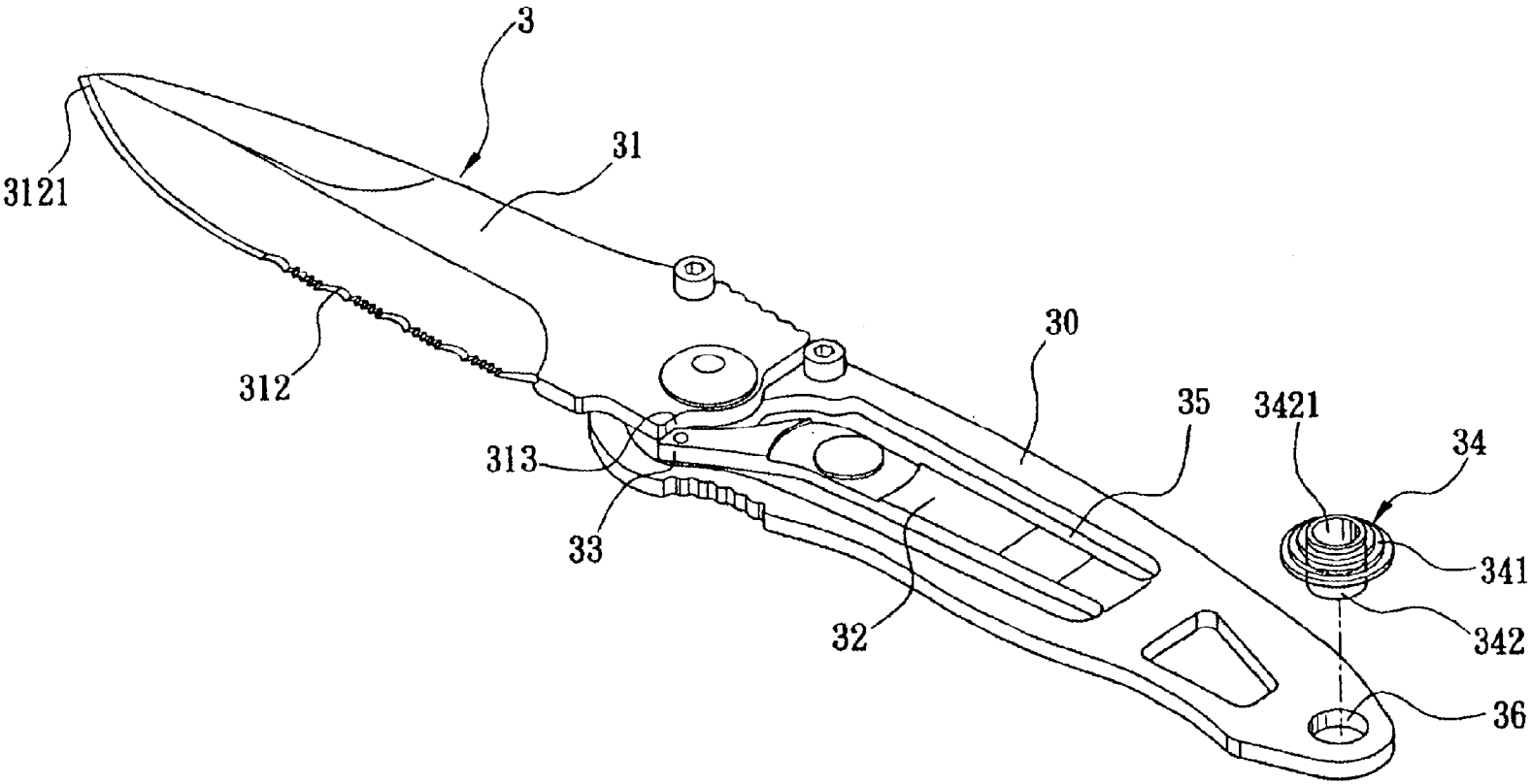
FIG. 1 is an isometric drawing of the invention herein when unfolded.
Figure 2:
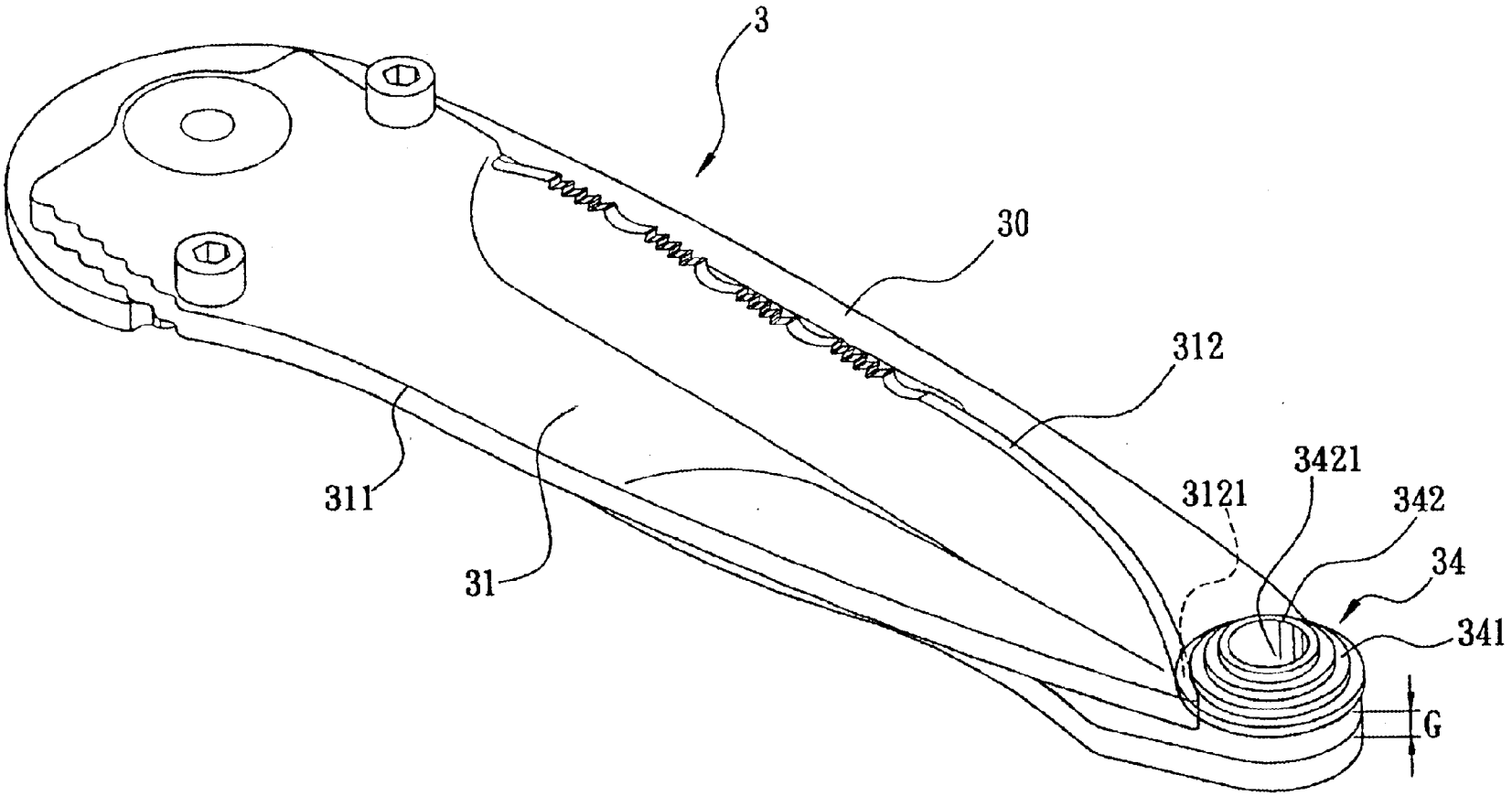
FIG. 2 is an isometric drawing of the invention herein when folded.

The invention herein is a single blade foldable knife; referring to FIG. 1 and FIG. 2, the embodiment of the invention herein consists of a foldable knife 3, a planar-shaped handle section 30 on which the foldable knife 3 is disposed, a blade 31 pivotably conjoined to an appropriate position at one extremity of the handle section 30, a mildly contoured facet 311 along the back of the blade 31, a cutting edge 312 formed on the opposite surface, a channel 35 suitably inset proximal to the center of the handle section 30, a resilient member 32 in the middle of the channel 35, one end of the resilient member 32 figured upward and, furthermore, slightly arcuate such that it has elastic properties, and a stop section 33 formed at the end of the resilient member 32, with the said stop section 33 capable of being postured against a notch 313 in the bottom portion of the unfolded blade 31, thereby enabling the stop section 33 to lock the blade 31 into position after it is unfolded. When the resilient member 32 is pressed, a bottom potion of the blade 31 is released from the end of the resilient member 32, enabling the blade 31 to be folded into the handle section 30.

Referring to FIG. 1 and FIG. 2, a hole 36 is formed in the handle section 30 at a position facing the tip 3121 of the cutting edge 312 when the blade 31 is folded, a protective component 34 is situated on the hole 36, a hollow rod 342 fixes the protective component 34 over the hole 36, and a protective circular cap 341 is mounted on the end of the hollow rod 342 such that a gap G is formed between the circular cap 341 and the handle section 30 that contains the cutting edge tip 3121.

Given the structural component assembly, when the blade 31 is folded, the tip 3121 of the cutting edge 312 is nested in the protective component 34, enabling the protective component 34 to ensconce the tip 3121 of the cutting edge 312 and render the cutting edge 312 totally incapable of external contact such that whether the user grasps, picks up, or carries the foldable knife 3, touching the cutting edge 312 is not possible due to the containment of the protective component 34 and, furthermore, other objects stored with the foldable knife 3 cannot strike the cutting edge 312, while wear of cutting edge 312 is also prevented because it is isolated from other objects; therefore, the protective component 34 achieves the objective of simultaneously protecting the user's hands and the cutting edge 312.

In the other embodiment of the invention herein, referring to FIG. 3, a chain 37 is coupled onto the hollow rod; the chain 37 is inserted through the non-solid portion (center hole 3421) of the hollow rod 342 (shown in FIG. 2) and thereby connected to the rear of the handle section 30, with a key 4 sleeved onto the chain 37 by inserting the chain 37 through the hole of the key 4 to link it onto the chain 37.

In yet another embodiment of the invention herein, a knife brand trademark can be imprinted onto the protective circular cap 341 to enhance the appearance of the folding knife 3.

What is claimed is:

1. A foldable knife device comprising:

a handle section and a blade, wherein the handle section is of a planar shape and has a resilient member;

the blade is pivotably conjoined at one extremity of the handle section such that when the blade is unfolded, an end of the resilient member is postured against a bottom portion of the blade and thereby further locks the blade into position;

when the resilient member is pressed, a bottom portion of the blade is released from the end of the resilient member, enabling the blade to be folded into the handle section;

a protective component disposed on an outer exposed portion of the handle section on a hole of said handle section at a position facing the cutting edge tip of the blade when the blade is folded and fixed onto the handle section, the protective component comprises a hollow rod disposed in the hole of the handle section and a protective circular cap is mounted on an end of the said hollow rod such that an unobstructed gap is formed between the circular cap and the outer portion of the handle section for receiving the tip of the cutting edge; and when the blade is folded, the tip of the blade cutting edge is nested in the gap.

2. The foldable knife device as claimed in claim 1, wherein a chain is coupled to the hollow rod.

3. The foldable knife device as claimed in claim 2, wherein the chain has a key sleeved thereon.

4. The foldable knife device as claimed in claim 1, wherein the protective circular cap can be imprinted with a knife brand trademark.

* * * * *